US011026852B2

(12) United States Patent
Linon

(10) Patent No.: US 11,026,852 B2
(45) Date of Patent: Jun. 8, 2021

(54) SUPPORTING STRUCTURE

(71) Applicant: Rodolphe Linon, Paris (FR)

(72) Inventor: Rodolphe Linon, Paris (FR)

(73) Assignee: HEXOWHEEL, Orsay (FR)

( * ) Notice: Subject to any disclaimer, the term of this patent is extended or adjusted under 35 U.S.C. 154(b) by 422 days.

(21) Appl. No.: 16/070,604

(22) PCT Filed: Feb. 14, 2017

(86) PCT No.: PCT/EP2017/053331
§ 371 (c)(1),
(2) Date: Jul. 17, 2018

(87) PCT Pub. No.: WO2017/140694
PCT Pub. Date: Aug. 24, 2017

(65) Prior Publication Data

US 2019/0015273 A1 Jan. 17, 2019

(30) Foreign Application Priority Data

Feb. 18, 2016 (EP) ..... 16305189

(51) Int. Cl.
*A61G 5/06* (2006.01)
*A61H 3/04* (2006.01)
(Continued)

(52) U.S. Cl.
CPC ..... *A61G 5/061* (2013.01); *A61G 5/04* (2013.01); *A61G 5/068* (2013.01); *A61G 5/122* (2016.11);
(Continued)

(58) Field of Classification Search
CPC ..... A61H 5/027; A61H 5/04; A61H 5/047; A61H 5/06; A61H 5/061; A61H 5/068;
(Continued)

(56) References Cited

U.S. PATENT DOCUMENTS 6,364,040 B1 * 4/2002 Klann ..... A63H 11/00 180/8.1
6,832,991 B1 * 12/2004 Inada ..... A61H 39/04 601/100
(Continued)

FOREIGN PATENT DOCUMENTS

EP 0 713 692 A1 5/1996
EP 2 785 578 B1 3/2016
(Continued)

OTHER PUBLICATIONS

International Search Report, dated Apr. 21, 2017, from corresponding PCT/EP2017/053331 application.

*Primary Examiner* — Minnah L Seoh
*Assistant Examiner* — Maurice L Williams
(74) *Attorney, Agent, or Firm* — Nixon & Vanderhye

(57) ABSTRACT

A supporting structure includes two pairs of legs and four wheels each arranged at a lower end of a respective one of the legs. Each leg includes an upper segment and a lower segment, and optionally a retractable leg extension segment for contacting ground instead of the corresponding wheel. Such supporting structure is adapted for producing a lowering motion while keeping the legs crossed on both lateral sides. Such supporting structure may be adapted for assisting a disabled person in travelling on the ground, and also possibly in climbing stairs.

20 Claims, 6 Drawing Sheets

(51) Int. Cl.

| | |
|---|---|
| ***A61H 3/00*** | (2006.01) |
| ***A61G 5/12*** | (2006.01) |
| ***A61G 5/14*** | (2006.01) |
| ***A61H 1/02*** | (2006.01) |
| ***A61G 5/04*** | (2013.01) |

(52) U.S. Cl.
CPC ..... *A61G 5/124* (2016.11); *A61G 5/127* (2016.11); *A61G 5/128* (2016.11); *A61G 5/14* (2013.01); *A61H 1/024* (2013.01); *A61H 1/0244* (2013.01); *A61H 1/0266* (2013.01); *A61H 3/00* (2013.01); *A61H 3/04* (2013.01); *A61H 2003/001* (2013.01); *A61H 2003/007* (2013.01); *A61H 2003/043* (2013.01); *A61H 2201/0161* (2013.01); *A61H 2201/1207* (2013.01); *A61H 2201/164* (2013.01); *A61H 2201/165* (2013.01); *A61H 2201/1623* (2013.01); *A61H 2201/1633* (2013.01)

(58) Field of Classification Search
CPC ..... A61H 5/08; A61H 5/0808; A61H 5/0858; A61H 5/104; A61H 5/122; A61H 5/124; A61H 5/127; A61H 5/128; A61H 5/14; A61H 1/024; A61H 1/0244; A61H 1/0262; A61H 1/0266; A61H 2201/161; A61H 2201/1623; A61H 2201/1633; A61H 2201/164; A61H 3/00; A61H 3/04; A61H 2003/001; A61H 2003/007; A61H 2003/043
See application file for complete search history.

(56) References Cited

U.S. PATENT DOCUMENTS

| | | | | |
|---|---|---|---|---|
| 7,673,718 | B2 * | 3/2010 | Asai | A61H 3/04 180/208 |
| 8,790,284 | B2 * | 7/2014 | Jeon | A61H 3/00 601/35 |
| 9,629,762 | B2 * | 4/2017 | Aviv | A61G 5/04 |
| 2008/0100036 | A1 * | 5/2008 | Ivanchenko | A61G 5/006 280/648 |
| 2009/0048686 | A1 * | 2/2009 | Ikeuchi | B25J 9/0006 623/27 |
| 2009/0289433 | A1 | 11/2009 | Asai et al. | |
| 2010/0270771 | A1 * | 10/2010 | Kobayashi | A61H 1/0255 280/210 |
| 2014/0265181 | A1 * | 9/2014 | Lambarth | A61G 5/104 280/28.5 |
| 2016/0022517 | A1 * | 1/2016 | Frangos | A61G 5/1054 280/657 |
| 2017/0071812 | A1 * | 3/2017 | Sandler | A61G 5/14 |

FOREIGN PATENT DOCUMENTS

| | | | | |
|---|---|---|---|---|
| JP | 11128278 | A | * | 5/1999 |
| KR | 2013 00001663 | A | | 1/2013 |
| WO | 2009/044568 | A1 | | 4/2009 |

* cited by examiner

SUPPORTING STRUCTURE

TECHNICAL FIELD OF THE INVENTION

The invention relates to a supporting structure, in particular intended for disabled persons for assisting them in moving during everyday life, possibly without extra human aid.

BACKGROUND OF THE INVENTION

Known devices intended for disabled persons include wheelchairs, optionally with motor propulsion, or frames for helping them to remain upright. But wheelchairs do not activate the legs of the disabled persons and keep them from standing up. Frames require a lot of muscular effort from the disabled persons in their arms for walking, because upright position is maintained through the hands of the person holding firmly the frame, and walking requires pushing or lifting the frame. As a result, there is still some need for another device designed for helping disabled persons to walk during everyday life, but without requiring important effort from these persons.

Also biped robots and biped exoskeletons already exist, which are capable of walking. But walking operations for most of them proceed through a series of quasi-static positions, including raising one foot while maintaining equilibrium on the other foot, moving the raised foot forward, putting it again on the ground and transferring the robot weight on this foot. But such quasi-static walking operation is limited in walking speed, as opposed to dynamic equilibrium which is involved in walking motions of human beings and animals. In particular, existing robots and exoskeletons do not implement alternation between stretching out one leg and bending it, and also do not implement temporary imbalance until pushing up through next pressing of one foot on the ground. Because of these reasons, existing biped robots and exoskeletons cannot walk in a soft and continuous motion and cannot jog along or run.

Starting from this situation, one object of the present invention consists in providing a new device capable of assisting disabled persons in walking during everyday life, and also optionally in climbing stairs or going downstairs.

In particular, a structure involved for such assistance to a disabled person is proposed by the invention, which is capable of soft and continuous walking motions with varying speeds.

Another object of the invention consists in allowing a disabled person to travel of the ground, while moving his legs at least for providing physical exercise for aiding recuperation.

Still another object of the invention consists in providing such device which is reduced in weight and size, or which is capable to have configurations with reduced dimensions.

SUMMARY OF THE INVENTION

For meeting at least one of these objects or others, the invention proposes a supporting structure which comprises:

- a load-receiving part, which is designed for receiving a load to be transported or assisted during moving;
- two pairs of legs, each leg pair being arranged from one lateral side of the load-receiving part which is opposite another lateral side of the load-receiving part dedicated to the other leg pair, all legs extending from the load-receiving part towards ground when the supporting structure is in use condition on horizontal ground, and being adapted for maintaining the load-receiving part above ground; and
- four wheels with respective rotation axes oriented horizontally when the supporting structure is in the use condition on horizontal ground, each leg being provided with one of the wheels at a lower end of this leg which is opposite a connection of the leg to the load-receiving part.

According to one feature of the invention, each leg comprises an upper segment and a lower segment, wherein for each leg an upper end of the upper segment is rotationally connected to the load-receiving part with a first rotation axis, and a lower end of the upper segment is rotationally connected to an upper end of the lower segment with a second rotation axis. A lower end of the lower segment forms the lower leg end which is opposite the connection of the leg to the load-receiving part. The first and second rotation axes of all legs are parallel and horizontal when the supporting structure is in the use condition on horizontal ground. Thus, thanks to the rotations of the upper leg segments with respect to the load-receiving part, and the rotations of the lower leg segments with respect to the upper leg segments, the supporting structure can have folded configurations which reduce its overall dimensions, and also unfolded configurations with increased stability above ground.

In addition, the supporting structure is adapted for producing a reference crossed leg position in the use condition on horizontal ground with the wheels all located on the ground, and in which both legs on each lateral side of the load-receiving part extend downwards while crossing each other in projection into a sagittal plane of the supporting structure. In particular, in such reference crossed leg position, the leg-crossing participates in reducing the overall dimensions of the supporting structure, making it easier to move with it or to worm in narrow spaces.

According to an additional feature of the invention, the supporting structure is further adapted for performing a lowering of the load-receiving part towards ground from the reference crossed leg position, by bending each leg upwardly about the second axis of this leg so as to reduce an angle between the upper and lower leg segments at the second axis, simultaneously for all four legs. Thus a first distance between both wheels on each lateral side of the load-receiving part is increased, while both legs on each lateral side keep crossing each other in projection into the sagittal plane. In this way, the supporting structure of the invention allows continuous and soft lowering of the load-receiving part. In particular, when the supporting structure of the invention is used as an exoskeleton intended for a disabled person, such continuous lowering allows transformation from a frame suitable for walk aid into a wheelchair configuration, without action from an assistant onto the structure.

Thanks to its four-leg configuration with each leach comprising two segments, the supporting structure of the invention can produce soft and continuous walking motion, including dynamic equilibrium with alternations between stretching out and bending for each leg, and short imbalance durations.

Preferably, the supporting structure may be further adapted so that during the lowering of the load-receiving part from the reference crossed leg position, both upper segments on each lateral side of the load-receiving part are simultaneously spread out through rotations of these upper segments about the first axes in opposite directions, so as to increase a second distance between the second axes on each lateral side of the load-receiving part. Such spread-out of the upper leg segments also lessens or suppresses the increase in the first distance between the wheels on each lateral side as resulting only from the bending of the legs about the second axes. Such rotations about the first axes participate in reducing further the overall dimensions of the supporting structure in the lowered configuration.

Possibly, the supporting structure may be further adapted so that the lowering of the load-receiving part is continued until abutting surfaces which are connected respectively to the upper and lower segments of each leg come into contact with each other for all legs, so as to stop further reduction in the angle between the upper and lower segments of each leg. Alternatively, the lowering of the load-receiving part may be continued until the four legs contact the ground at the four second axes in addition to the four wheels, or at any other protruding portions of the lower leg segments.

In preferred implementations of the invention, the supporting structure may comprise at least one first motor system which is arranged for driving the lower segments of the legs in rotation about their respective second axes, and also optionally for driving simultaneously the upper segments of the legs in rotation about their respective first axes, during the lowering of the load-receiving part from the reference crossed leg position. Change in configuration of the supporting structure can thus be produced without effort from a user, operator or assistant. In particular, the first motor system may comprise motor units which are each dedicated to producing rotation of one of the upper and lower leg segments about one of the first or second axes, separately from the other motor units dedicated to producing rotations of other ones of the upper and lower leg segments.

Advantageously, the supporting structure may be further adapted for moving the legs about the first axes from the reference crossed leg position so as to uncross both legs on each lateral side of the load-receiving part, in projection into the sagittal plane, thereby producing an uncrossed leg position. Stability of the supporting structure on the ground is thus further increased in the uncrossed configurations of the supporting structure. Then, it may be adapted for moving the legs from the uncrossed leg position so as to produce a walk motion of four-footed animal type. Such walk motion may suit uneven grounds better than rolling with the wheels, whereas rolling allows faster and softer moving on even grounds.

Possibly, at least one second motor system may be arranged in the supporting structure for driving at least two of the wheels in rotation, so that the supporting structure travels on the ground through rolling.

Advantageously again, each leg may further comprise a retractable leg extension segment which is arranged for extending downwards so as to push on the ground instead of the wheel of this leg. Then, each leg extension segment may be provided with a ground-contacting pad and have an extension length such that the leg is longer when the leg extension segment is extended, compared to the leg contacting the ground with its wheel when its leg extension segment is no longer extended. Increased stability of the supporting structure on the ground can also be provided by such extensions. In addition, undesired rolling of the supporting structure on the ground can be prevented by the ground-contacting pads. Then, the supporting structure may be further adapted for being controlled for climbing a step or stairs, with the leg extension segments extended for at least two of the legs. Also, the leg extension segments can compensate for the step height and thus maintain the load-receiving part in a substantially horizontal attitude. Preferably, extending and/or retracting of each leg extension segment may be produced by a motor system.

For first applications of the invention, the supporting structure may be adapted for forming an exoskeleton intended for a disabled person, in which the load-receiving part is a seat or backrest adapted for supporting at least one among a pelvis or a trunk of the disabled person. For such applications of the invention, the wheels may be freewheels during at least part of the use of the supporting structure by the disabled person. Thus, the supporting structure may be adapted for being moved on the ground by the feet of the disabled person contacting and pulling the ground while the pelvis or trunk of the disabled person is supported by the load-receiving part. Also the supporting structure may further comprise two jointed supports which extend from the load-receiving part, and which are adapted to move the legs of the disabled person in a manner coordinated with respect to a moving of the supporting structure. For such applications for disabled persons, at least a portion of the load-receiving part forming the seat or backrest may rotate about a horizontal axis, with respect to locations of the first axes, preferably independently from the attitudes and rotations of the leg segments.

For another application of the invention, the load receiving part may be suitable for adapting to a biped robot standing on the ground while allowing the biped robot to walk, and the supporting structure increasing stability for the biped robot.

For still other applications of the invention, the supporting structure may be adapted for forming part of a terrestrial drone, capable of moving on a great variety of grounds and clearing over obstacles.

BRIEF DESCRIPTION OF THE DRAWINGS

These and other features of the invention will be now described with reference to the appended figures, which relate to preferred but not-limiting embodiments of the invention.

For clarity sake, element sizes which appear in these figures do not correspond to actual dimensions or dimension ratios. Also, same reference numbers which are indicated in different ones of the figures denote identical elements of elements with identical function.

DETAILED DESCRIPTION OF THE INVENTION

Figure 1A:
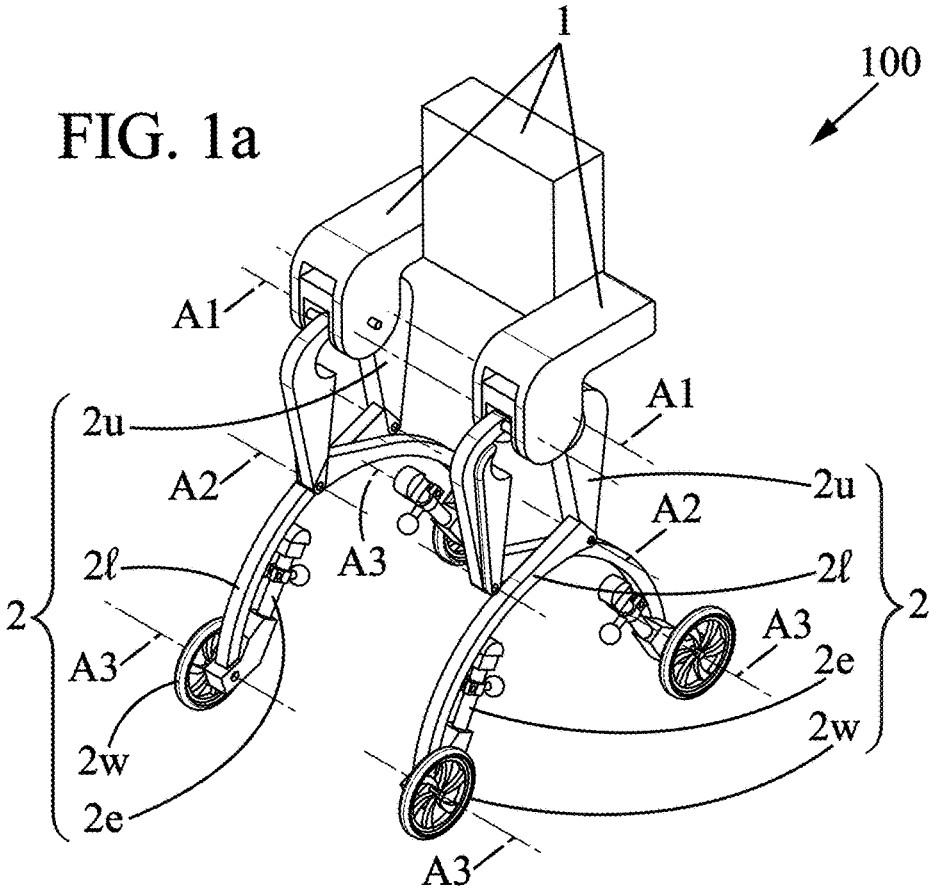
FIGS. 1*a* and 1*b* are two perspective views of a supporting structure in accordance with the invention.

FIG. 1*a* illustrates in a simplified manner a supporting structure in accordance with the invention. The structure, which is denoted 100 as a whole, comprises a load-receiving part 1 and four legs each denoted 2. The legs are distributed into two pairs, each pair located on a lateral side of the load-receiving part 1, symmetrical to the other leg pair located on the other lateral side, but any leg can have an instant position different from the other legs. Preferably both legs which have connections to the load-receiving part 1 offset towards the front of the structure 100, one such leg on either lateral side, have symmetrical design, and also for both legs which have connections to the load-receiving part 1 offset towards the back of the structure 100. Possibly, both legs on one and same lateral side may have symmetrical design but inverted in accordance with frontward and backward directions.

Unless specified differently, the description refers to the supporting structure 100 positioned on horizontal ground with the legs 2 supporting the load-receiving part 1 at a distance above the ground. In particular, each leg 2 extends from the load-receiving part 1 downwards in a reference leg position. Each leg 2 comprises an upper leg segment 2*u*, a lower leg segment 2*l*, a wheel 2*w*, and optionally an additional extension leg segment which will be discussed later below. In the reference leg position, an upper end of the upper leg segment 2*u* is situated higher above ground than a lower end of the same upper leg segment 2*u*, and an upper end of the lower leg segment 2*l* is also situated higher than a lower end of the same lower leg segment 2*l*, for each leg 2 separately. Again for each leg 2, the upper end of the upper leg segment 2*u* is connected to the load-receiving part 1 through a rotational connection system having rotation axis A1, denoted first axis in the general description part above. Also the lower end of the upper leg segment 2*u* is connected to the upper end of the lower segment 2*l* in the same leg 2 through another rotational connection system having rotation axis A2, denoted second axis in the general description part. And each wheel 2*w* is connected to the lower end of the lower leg segment 2*l* within each leg 2 through still another rotational connection system having rotation axis A3. The four rotation axes A1, the four rotation axes A2 and possibly also the four rotation axes A3 are all horizontal and parallel, perpendicular to a vertical sagittal plane of the structure 100, located between both lateral sides. Preferably, each rotational connection system about any one of the axes A1, A2 or A3 is provided with a motor unit (not represented) suitable for moving rotationally the connected elements with respect to one another. Preferably again, the motor units for rotations about the A1-axes and A2-axes are servomotors. All motor units for rotations about the A1-axes or A2-axes form a first motor system dedicated to changing the leg attitudes. The motor units arranged for driving the wheels 2*w* in rotation about the A3-axes form a second motor system dedicated to rolling the supporting structure 100 on the ground. The travelling motion of the supporting structure 100 on the ground may be produced by the four motor units which are provided respectively to the wheels 2*w*, by controlling consistently all wheel rotations. For changing the travelling direction, i.e. changing the orientation of the forward direction of the supporting structure 100 in a plane parallel to the ground, clockwise or anticlockwise rotations and speeds for all four wheels 2*w* may be controlled appropriately. Thus, slips and frictions of the rotating wheels 2*w* against the ground make the supporting structure 100 turning left or right. At least one among the first and second motor systems may be powered using batteries (not represented) arranged on-board the supporting structure 100, for example contained within or affixed to the load-receiving part 1. Control of all motor units in a coordinated manner is supposed to be accessible to the Man skilled in robotics without inventiveness.

Figure 1B:
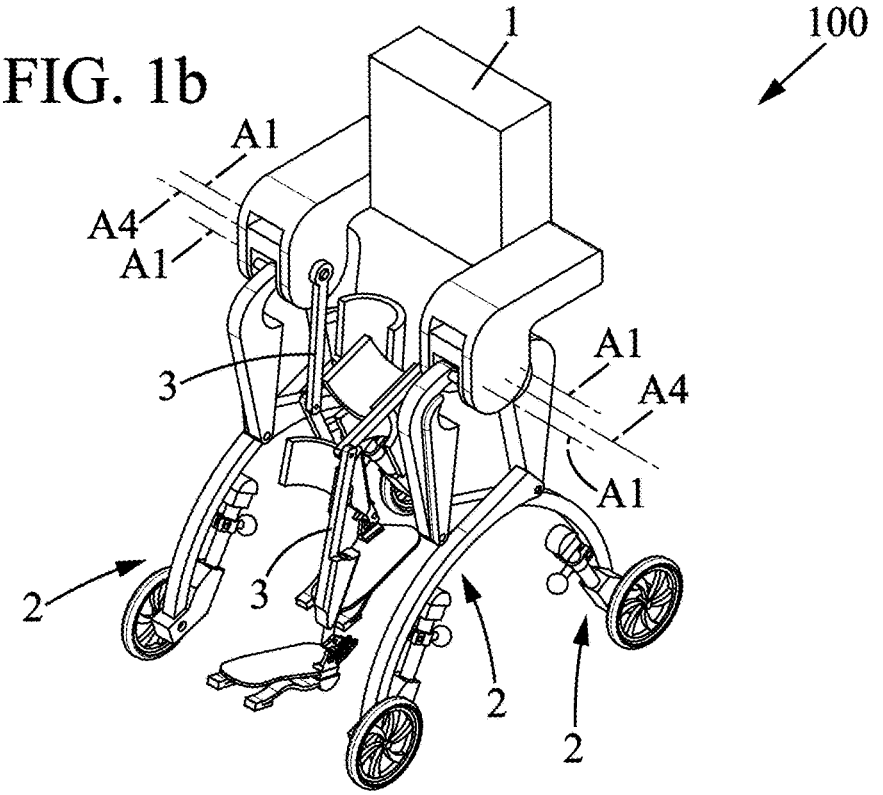

FIG. 1*b* is a completed version of FIG. 1*a* when the supporting structure 100 is dedicated to aiding a disabled person in moving on the ground. For such application, the load-receiving part 1 may be a seat or backrest for supporting the pelvis or trunk of the disabled person. Then, the load-receiving part 1 together with the four legs 2 form an exoskeleton capable of transporting the disabled person or helping him to travel on the ground. Preferably, the supporting structure 100 may be further adapted so that the load-receiving part 1 can be varied in angle around an additional axis A4 located substantially between the first A1-axes on each lateral side, and parallel to the A1-axes. Such rotation of the seat- and/or backrest forming load-receiving part 1 allows accommodating varying attitudes of the disabled person for maintaining equilibrium. For example, the supporting structure 100 may be moved on ground by the feet of the disabled person contacting and pulling the ground while his pelvis or trunk is supported by the load-receiving part 1. For such operation, the wheels 2*w* may be freewheels for not impeding motion of the supporting structure 100 on the ground, as driven by the person. Also in such embodiments of the invention, the wheels 2*w* may be swivel wheels with swivel axes oriented vertically for further suppressing any hindrance against the motion driven by the person. As shown in FIG. 1*b*, the supporting structure 100 dedicated to a disabled person may further comprise two jointed supports 3 designed for supporting the legs of the disabled person, or aiding him in moving his legs. In particular, the supports 3 may drive the person's legs into a motion which is coordinated with the motion of the supporting structure 100 on the ground. The supports 3 may be segmented with intermediate rotational connections for controlling the femoral, tibial and foot attitudes of the disabled person. Additionally, each support 3 may also comprise suitable contact areas, for pressing against the thigh, calf and foot sole.

Figure 2A:
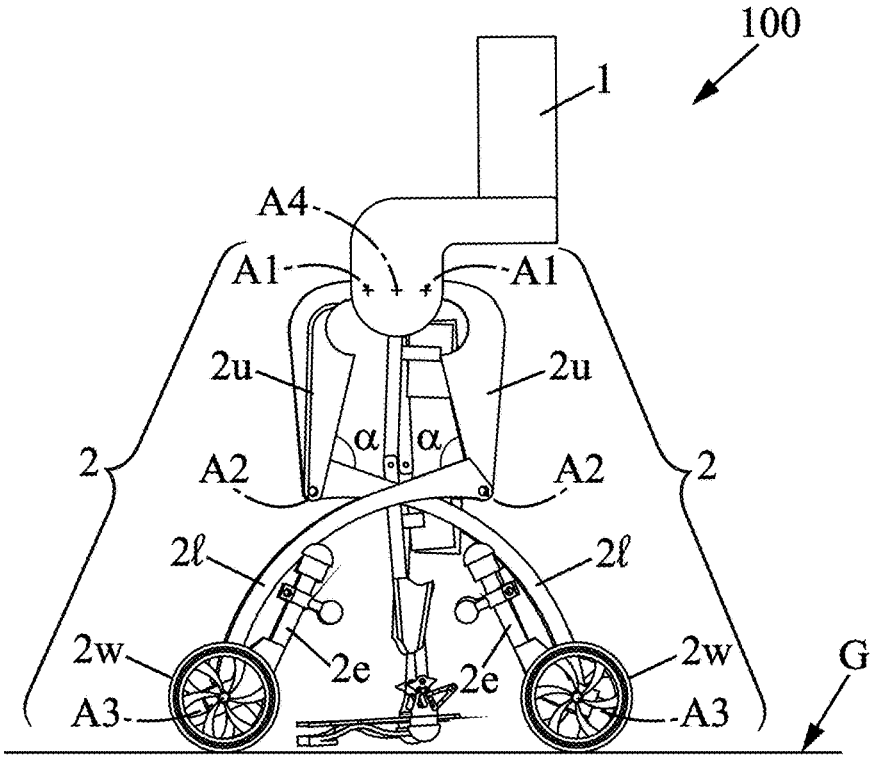
FIGS. 2*a* to 2*c* illustrate a lowering motion of the supporting structure of FIGS. 1*a* and 1*b*.
Figure 2B:
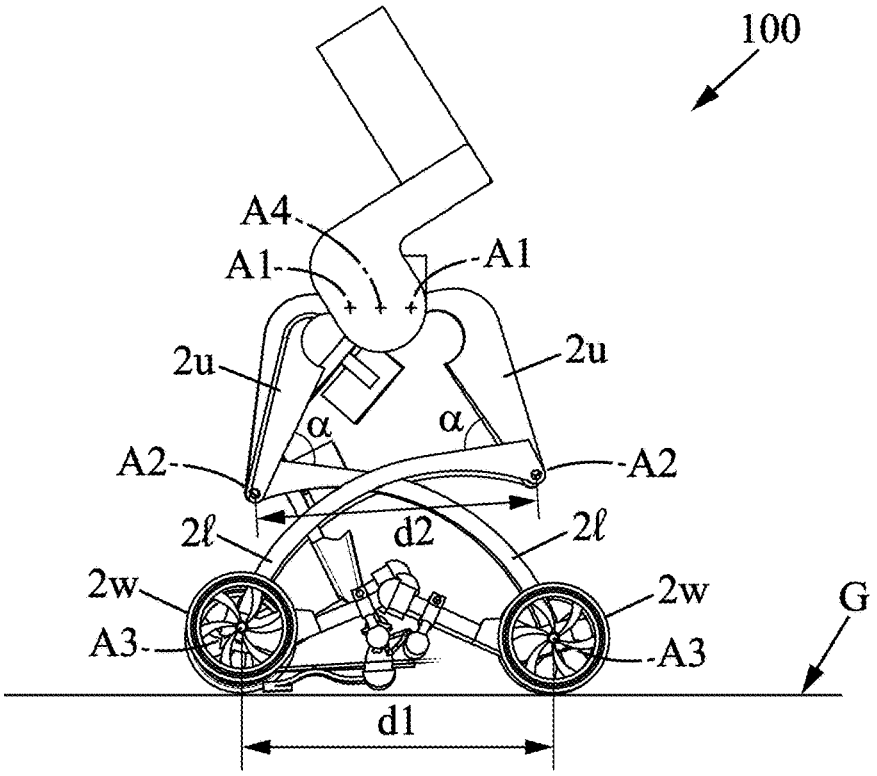
Figure 2C:
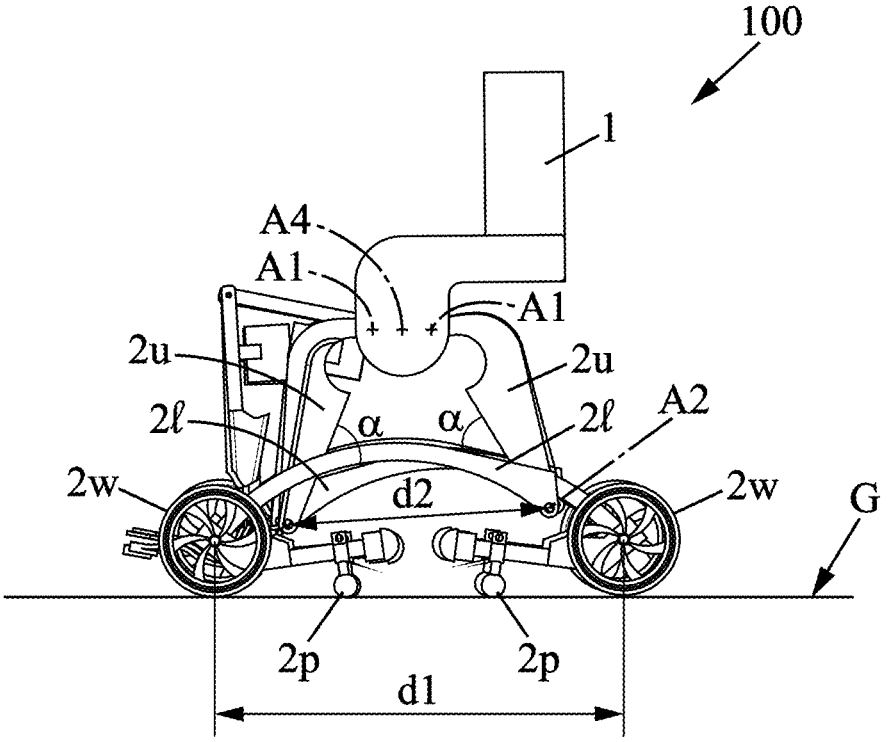

FIGS. 2*a*-2*c* show a main attitude variation produced by a supporting structure 100 in accordance with the invention. Such attitude variation results in a change in the height of the load receiving part 1 above the ground, denoted G. Starting from the reference crossed leg position of FIG. 2*a*, with the four legs 2 having continually symmetrical attitudes, the legs are simultaneously bent upwards by controlling rotation of the lower leg segments 2*l* about the A2-axes so as to reduce the angles $\alpha$ between the upper leg segments 2*u* and the lower leg segments 2*l*, with angle apex at the A2 axes. This results in increasing the distance d1 between the front and back wheels 2*w* on each lateral side, while lowering the load-receiving part 1. Preferably, the rotations of the upper leg segments 2*u* with respect to the load-receiving part 1 are also activated simultaneously, for spreading out the upper leg segments 2*u* on each lateral side, simultaneously for both lateral sides. This results in a further lowering of the load-receiving part 1, while lessening the increase in the distance d1 between the front and back wheels 2*w*. Simultaneously, spreading out the upper leg segments 2*u* increases the distance d2 between the A2-axes of both legs 2 on each lateral side. In this way, the overall length of the supporting structure 100 parallel to the ground G in the lowered attitude is reduced with respect to the only bending of the legs 2 about the A2-axes. Abutting surfaces which may be provided to the upper leg segment 2*u* and lower leg segment 2*l* of each leg 2, may come into contact with each other for all legs, so as to block further reduction in the angles $\alpha$, and thus stop the lowering of the load-receiving part 1. Alternatively, the lowering may be continued until the four legs 2 contact the ground G at the A2-axes in addition to the four wheels 2*w*. Still alternatively, the legs 2 may each be provided with protruding portions 2*p* (FIG. 2*c*) which are fixed with respect to the lower leg segments 2*l* during lowering of the load-receiving part 1. Then, the lowering may be continued until these protruding portions 2*p* contact the ground G. Possibly, the rotations about the A2-axes may be continued until the wheels 2*w* lift above the ground G and the supporting structure 100 pushes onto the ground G only through the protruding portions 2*p*.

For the application of assisting a disabled person, it is preferable that the load-receiving part 1 forming seat and/or backrest is leant forward for helping the person to maintain his equilibrium during the sitting movement (see FIG. 2*b*).

Motion reverse to the lowering just described for the supporting structure 100 leads to increasing the height of the load-receiving part 1 above the ground G. This may correspond to standing-up of the disabled person from the sitting position.

Figure 3A:
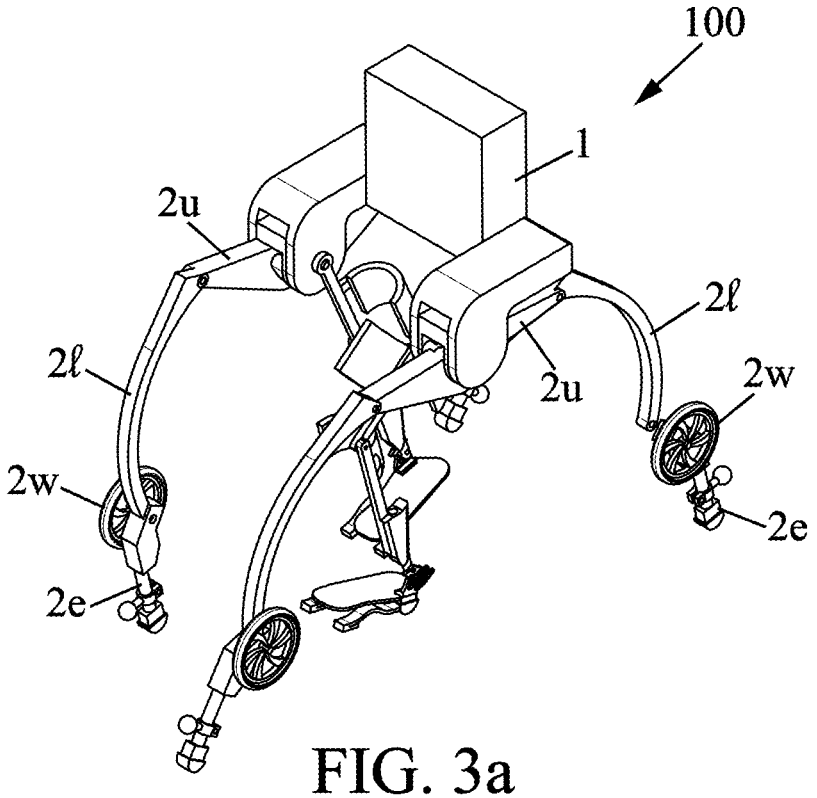
FIGS. 3*a* and 3*b* illustrate another attitude of the supporting structure of FIGS. 1*a* and 1*b*, involved for travelling on the ground.
Figure 3B:
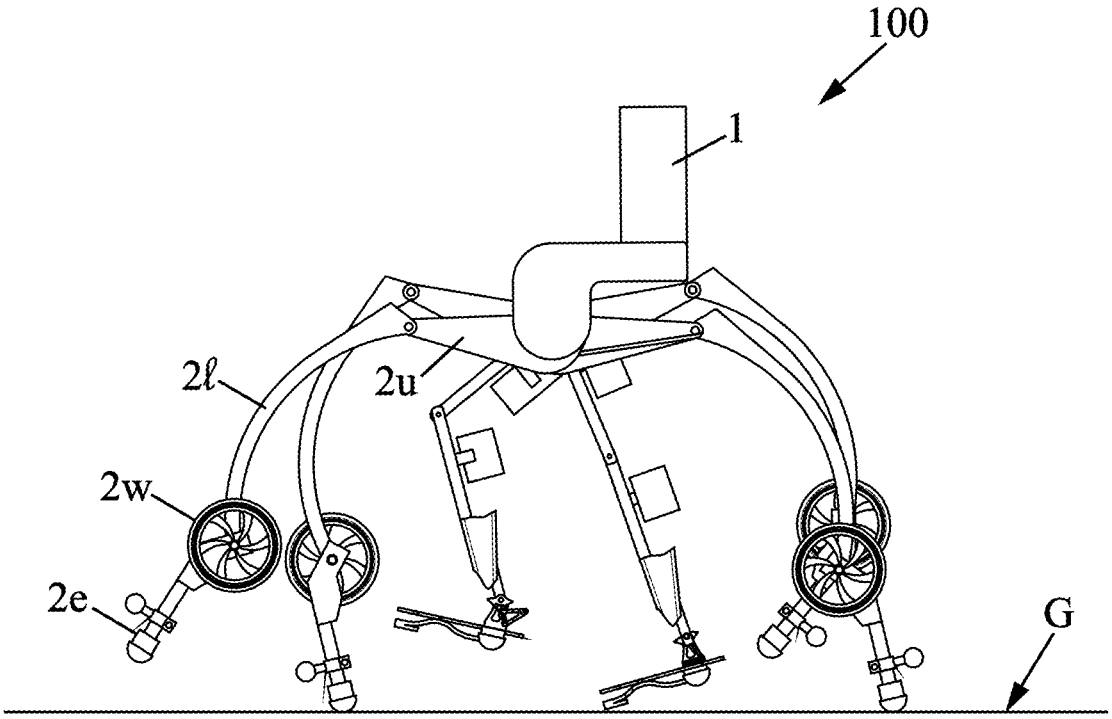

As just explained, attitudes of the supporting structure 100 with both legs 2 on each lateral side which cross each other, are advantageous in a great number of situations. Namely, in such crossed leg positions, the leg of one of the lateral sides which has its A1-axis shifted backwards with respect to the A1-axis of the other leg of the same lateral side, has its lower leg end at a location on the ground which is shifted forwards with respect to the lower leg end of the other leg relating to the same lateral side. This applies to both lateral sides for the so-called crossed leg positions. But uncrossed leg positions may be advantageous for other situations, for example when increased stability is required. Then for such uncrossed leg positions, the leg of one of the lateral sides which has its A1-axis shifted forwards with respect to the A1-axis of the other leg of the same lateral side, has its lower leg end at a location on the ground which is shifted forwards with respect to the lower leg end of the other leg relating to the same lateral side. FIGS. 3*a* and 3*b* illustrate such uncrossed leg positions. In particular, a reference uncrossed leg position may be the four legs 2 extending straight with all angles $\alpha$ equaling 180°, vertically or spreading out on each lateral side of the load-receiving part 1.

For example, rotations of the wheels 2*w* may be impeded using appropriate rotation blocking arrangements, and the four legs 2 may be activated from the reference uncrossed leg position for producing a walk motion similar to that of a four-footed animal. Such walk motion may be more appropriate than rolling for uneven grounds, for the supporting structure 100 to travel without incurring damages.

Improved embodiments of the invention implement leg extension segments 2*e* which are provided at the lower ends of all legs 2. Such leg extension segments are optional but when implemented, they are each connected to the corresponding lower leg end so as to be either extended or retracted. When extended, each leg extension segment 2*e* contacts the ground instead of the corresponding wheel 2*w*. Preferably, each leg extension segment 2*e* may be provided at its lower end with a ground-contacting pad for avoiding any gliding of the leg 2 on the ground. Also preferably, each leg extension segment 2*e* increases the overall length of the corresponding leg 2, compared to this leg 2 contacting the ground with its wheel 2*w*. Extension or retraction of each leg extension segment 2*e* may be produced by a motor system, using any mechanical arrangement known in the art. Also, each leg extension segment 2*e* may be provided with a small freewheel which is connected to this segment at an intermediate location in the length segment. Such small freewheel may form the protruding portion 2*p*, and may useful during stretching of each leg extension segment for allowing its lower end to move softly on the ground.

FIGS. 3*a* and 3*b* show a first advantageous use of the leg extension segments 2*e* for producing the travelling motion similar to a four-footed animal in a more efficient manner. Efficiency is improved first because of avoiding that the wheels 2*w* can roll on the ground G, and also because the leg length is increased.

Figure 4A:
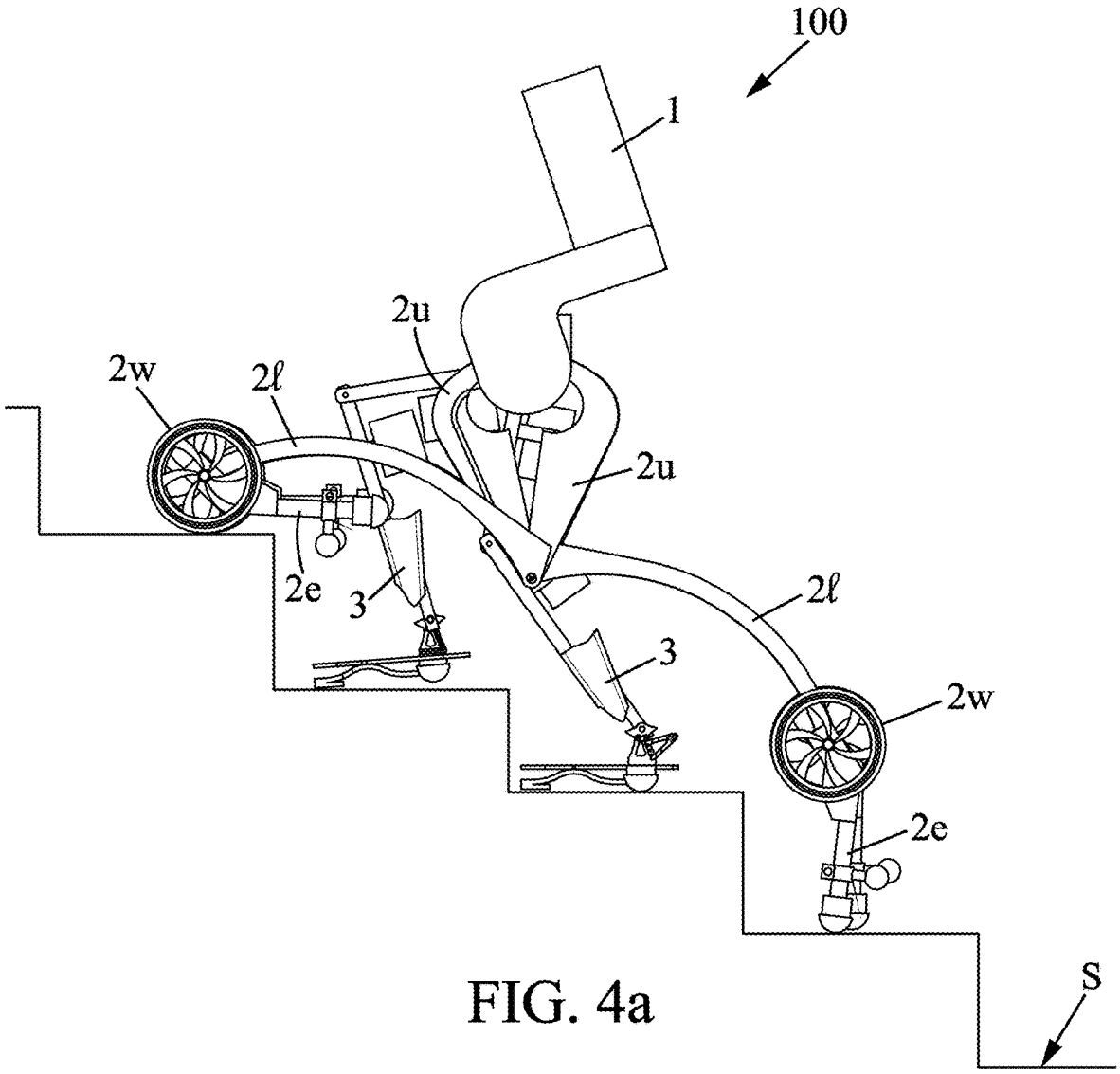
FIGS. 4*a* and 4*b* illustrate still other attitudes of the supporting structure of FIGS. 1*a* and 1*b*, involved for climbing stairs or going downstairs respectively.
Figure 4B:
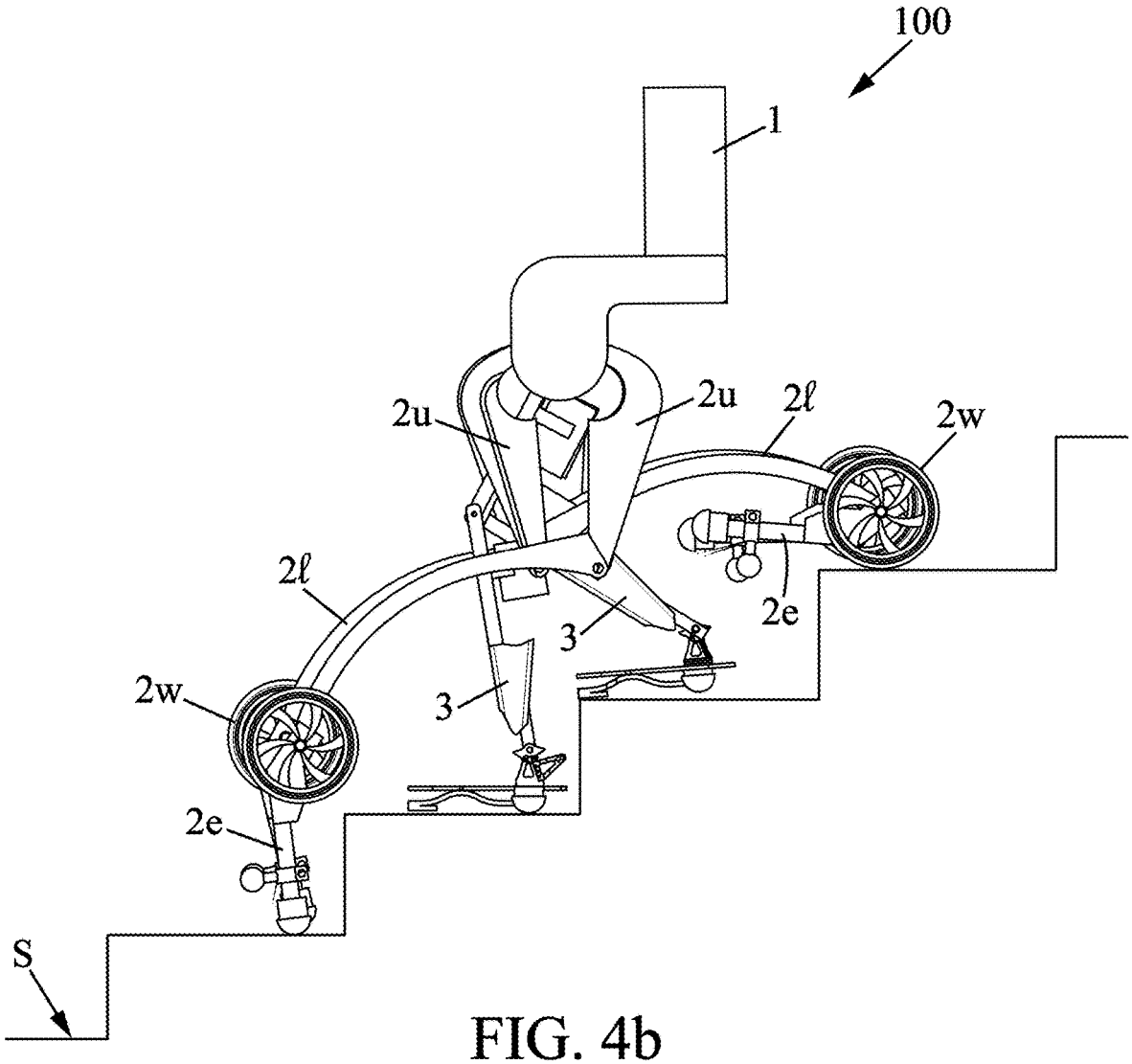

FIGS. 4*a* and 4*b* show another advantageous use of the leg extension segments 2*e* for climbing stairs S (FIG. 4*a*) or going downstairs (FIG. 4*b*). It is preferable that the leg extension segments 2*e* are used in stairs only for the two legs 2 which are located on steps downwards, so as to compensate for the difference in the height between front legs and back legs. Driving the movements of all four legs 2 synchronously for producing the upstairs or downstairs climbing motion can then be easily programmed. For the application of aiding a disabled person in moving, and when the seat or backrest can be changed in angle in projection into the sagittal plane, the seat or backrest is preferably leant forwards when going upstairs (FIG. 4*a*) for improving the person's equilibrium.

It is obvious that the invention can be implemented with adapting or changing secondary aspects thereof with respect to the above-description, while maintaining at least some of the advantages cited. For example, the first motor system dedicated for moving the legs 2 about the A1- and A2-axes, and optionally also for extending and retracting the leg extension segments 2*e*, may be a liquid pump coupled to liquid-controlled actuators which are arranged for being actuated by liquid pressure produced by the pump. The liquid pump may be electrically powered using batteries installed on-board the supporting structure. Each liquid-controlled actuator may be dedicated to producing rotation of one of the upper leg segments 2*u* or lower leg segments 2*l* about one of the A1- or A2-axes, separately from the other liquid-controlled actuators dedicated to producing rotations of other ones of the upper and lower segments. One separate liquid-controlled actuator may also be provided for extending and retracting each one of the leg extension segments. Possibly, such liquid-based motor system may be used in addition for driving the wheels 2*w* in rotation, so as to produce travelling of the supporting structure 100 on the ground. One liquid pump may be shared by all leg-moving actuators and wheel-driving devices.

Also, the shapes and proportions of all parts of the supporting structure as represented in the figures are only for illustrative purpose, and may be varied in large extents.

Another application of a supporting structure in accordance with the invention may be stabilization of a biped robot. Then, the load receiving part is designed for adapting to the biped robot standing on the ground, while allowing the biped robot to walk. The rotations of the wheels 2*w* or the movements of the legs 2 are then synchronized with the walking motion of the biped robot.

Still another application of a supporting structure in accordance with the invention may be forming a terrestrial drone, capable of travelling on a great variety of grounds, and with variable travelling speeds. Indeed, using the leg extension segments 2*e* may allow travelling on uneven grounds and getting over obstacles, whereas rolling allows higher travelling speeds.

The invention claimed is:

1. A supporting structure (100), comprising:

a load-receiving part (1), configured for receiving a load to be transported or assisted during moving;

two pairs of legs (2), each leg pair being arranged from one lateral side of the load-receiving part which is opposite another lateral side of said load-receiving part dedicated to the other leg pair, all legs (2) extending from the load-receiving part (1) towards ground when the supporting structure (100) is in a use condition on horizontal ground, and being adapted for maintaining the load-receiving part above the ground; and four wheels (2*w*) with respective rotation axes oriented horizontally when the supporting structure (100) is in the use condition on horizontal ground, each leg (2) being provided with one of said wheels at a lower end of said leg which is opposite a connection of said leg to the load-receiving part (1), wherein each leg (2) comprises an upper segment (2*u*) and a lower segment (21), wherein for each leg an upper end of the upper segment is rotationally connected to the load-receiving part (1) with a first rotation axis (A1), and a lower end of the upper segment is rotationally connected to an upper end of the lower segment with a second rotation axis (A2), and a lower end of the lower segment forming the lower leg end opposite the connection of said leg to the load-receiving part, first and second rotation axes of all legs being parallel and horizontal when the supporting structure (100) is in the use condition on horizontal ground, wherein the supporting structure (100) is adapted to be configured into a reference crossed leg position in the use condition on horizontal ground with the wheels (2*w*) all located on the ground, in which both legs (2) on each lateral side of the load-receiving part (1) extend downwards while crossing each other in projection into a sagittal plane of the supporting structure, wherein the supporting structure (100) is further adapted for performing a lowering of the load-receiving part (1) towards the ground from the reference crossed leg position, by bending each leg (2) upwardly about the second axis (A2) of said leg so as to reduce an angle (α) between the upper (2*u*) and lower (21) segments of said leg at the second axis, simultaneously for all four legs, thus increasing a first distance (d1) between both wheels (2*w*) on each lateral side of the load-receiving part, while both legs on each lateral side keep crossing each other in projection into the sagittal plane, said supporting structure (100) configured for forming an exoskeleton for a disabled person in which the load-receiving part (1) is a seat or backrest adapted for supporting at least one among a pelvis or a trunk of the disabled person, the wheels (2*w*) being freewheels during at least part of use of said supporting structure by the disabled person, and the supporting structure being movable on the ground by feet of the disabled person contacting and pulling the ground while the pelvis or trunk of said disabled person is supported by the load-receiving part (1).

2. The supporting structure (100) of claim 1, further adapted so that during the lowering of the load-receiving part (1) from the reference crossed leg position, both upper segments (2*u*) on each lateral side of the load-receiving part are simultaneously spread out through rotations of said upper segments about the first axes (A1) in opposite directions, so as to increase a second distance (d2) between the second axes (A2) on each lateral side of the load-receiving part, thereby lessening or suppressing the increase in the first distance between the wheels (2*w*) on each lateral side as resulting only from the bending of the legs (2) about the second axes.

3. The supporting structure (100) of claim 2, further adapted so that the lowering of the load-receiving part (1) is continued until abutting surfaces connected respectively to the upper (2*u*) and lower (21) segments of each leg (2) come into contact with each other for all legs, so as to stop further reduction in the angle (α) between the upper and lower segments of each leg, or until the four legs contact the ground at the four second axes (A2) in addition to the four wheels (2*w*).

4. The supporting structure (100) of claim 2, further adapted such that the legs (2) are movable about the first axes (A1) from the reference crossed leg position so as to uncross both legs on each lateral side of the load-receiving part (1), in projection into the sagittal plane, thereby producing an uncrossed leg position.

5. The supporting structure (100) of claim 1, further adapted so that the lowering of the load-receiving part (1) is continued until abutting surfaces connected respectively to the upper (2*u*) and lower (21) segments of each leg (2) come into contact with each other for all legs, so as to stop further reduction in the angle (α) between the upper and lower segments of each leg, or until the four legs contact the ground at the four second axes (A2) in addition to the four wheels (2*w*).

6. The supporting structure (100) of claim 1, further comprising at least one first motor system arranged for driving the lower segments (21) of the legs (2) in rotation about the respective second axes (A2), during the lowering of the load-receiving part (1) from the reference crossed leg position.

7. The supporting structure (100) of claim 6, wherein the first motor system comprises motor units each dedicated to producing rotation of one of the upper (2*u*) and lower (21) segments about one of the first (A1) or second (A2) axes, separately from other motor units dedicated to producing rotations of other ones of the upper and lower segments.

8. The supporting structure of claim 6, wherein the at least one first motor system also drives simultaneously the upper segments (2*u*) of the legs (2) in rotation about the respective first axes (A1).

9. The supporting structure (100) of claim 1, further adapted such that the legs (2) are movable about the first axes (A1) from the reference crossed leg position so as to uncross both legs on each lateral side of the load-receiving part (1), in projection into the sagittal plane, thereby producing an uncrossed leg position.

10. The supporting structure (100) of claim 9, adapted for moving the legs (2) from the uncrossed leg position so as to produce a walk motion of a four-footed animal.

11. The supporting structure (100) of claim 1, further comprising at least one second motor system arranged for driving at least two of the wheels (2*w*) in rotation, so that the supporting structure travels on the ground through rolling.

12. The supporting structure (100) of claim 1, wherein each leg (2) further comprises a retractable leg extension segment (2*e*) configured for extending downwards so as to push on the ground instead of the wheel (2*w*) of said leg, each leg extension segment being provided with a ground-contacting pad and having an extension length such that the leg is longer when the leg extension segment is extended, compared to the leg contacting the ground with the wheel of said leg when said leg extension segment is not extended.

13. The supporting structure (100) of claim 12, further adapted for being controlled for climbing a step or stairs, with the leg extension segments (2*e*) extended for at least two of the legs (2).

14. The supporting structure (100) of claim 12, adapted so that extending of each leg extension segment (2*e*) is produced by a motor system.

15. The supporting structure (100) of claim 1, further comprising:

two jointed supports (3) extending from the load-receiving part (1) and adapted to move the legs of the disabled person in a coordinated manner with respect to a moving of the supporting structure.

16. The supporting structure (100) of claim 1, wherein the load receiving part (1) is suitable for adapting to a biped robot standing on the ground while allowing the biped robot to walk, and said supporting structure increasing stability for the biped robot.

17. A supporting structure (100), comprising:

a load-receiving part (1), designed for receiving a load to be transported or assisted during moving;

two pairs of legs (2), each leg pair being arranged from one lateral side of the load-receiving part which is opposite another lateral side of said load-receiving part dedicated to the other leg pair, all legs (2) extending from the load-receiving part (1) towards ground when the supporting structure (100) is in a use condition on horizontal ground, and being adapted for maintaining the load-receiving part above the ground; and four wheels (2*w*) with respective rotation axes oriented horizontally when the supporting structure (100) is in the use condition on horizontal ground, each leg (2) being provided with one of said wheels at a lower end of said leg which is opposite a connection of said leg to the load-receiving part (1), wherein each leg (2) comprises an upper segment (2*u*) and a lower segment (21), wherein for each leg an upper end of the upper segment is rotationally connected to the load-receiving part (1) with a first rotation axis (A1), and a lower end of the upper segment is rotationally connected to an upper end of the lower segment with a second rotation axis (A2), and a lower end of the lower segment forming the lower leg end opposite the connection of said leg to the load-receiving part, first and second rotation axes of all legs being parallel and horizontal when the supporting structure (100) is in the use condition on horizontal ground, wherein the supporting structure (100) is adapted for producing a reference crossed leg position in the use condition on horizontal ground with the wheels (2*w*) all located on the ground, in which both legs (2) on each lateral side of the load-receiving part (1) extend downwards while crossing each other in projection into a sagittal plane of the supporting structure, wherein the supporting structure (100) is further adapted for performing a lowering of the load-receiving part (1) towards the ground from the reference crossed leg position, by bending each leg (2) upwardly about the second axis (A2) of said leg so as to reduce an angle ($\alpha$) between the upper (2*u*) and lower (21) segments of said leg at the second axis, simultaneously for all four legs, thus increasing a first distance (d1) between both wheels (2*w*) on each lateral side of the load-receiving part, while both legs on each lateral side keep crossing each other in projection into the sagittal plane, wherein each leg (2) further comprises a retractable leg extension segment (2*e*) configured for extending downwards so as to push on the ground instead of the wheel (2*w*) of said leg, each leg extension segment being provided with a ground-contacting pad and having an extension length such that the leg is longer when the leg extension segment is extended, compared to the leg contacting the ground with the wheel of said leg when said leg extension segment is not extended.

18. The supporting structure (100) of claim 17, further adapted for being controlled for climbing a step or stairs, with the leg extension segments (2*e*) extended for at least two of the legs (2).

19. The supporting structure (100) of claim 17, adapted so that extending of each leg extension segment (2*e*) is produced by a motor system.

20. A method for assisting movement by a disabled person, comprising:

providing a support structure to the person, the support structure comprising a load-receiving part (1), configured for receiving a load to be transported or assisted during moving, two pairs of legs (2), each leg pair being arranged from one lateral side of the load-receiving part which is opposite another lateral side of said load-receiving part dedicated to the other leg pair, all legs (2) extending from the load-receiving part (1) towards ground when the supporting structure (100) is in a use condition on horizontal ground, and being adapted for maintaining the load-receiving part above the ground, and four wheels (2*w*) with respective rotation axes oriented horizontally when the supporting structure (100) is in the use condition on horizontal ground, each leg (2) being provided with one of said wheels at a lower end of said leg which is opposite a connection of said leg to the load-receiving part (1), wherein each leg (2) comprises an upper segment (2*u*) and a lower segment (21), wherein for each leg an upper end of the upper segment is rotationally connected to the load-receiving part (1) with a first rotation axis (A1), and a lower end of the upper segment is rotationally connected to an upper end of the lower segment with a second rotation axis (A2), and a lower end of the lower segment forming the lower leg end opposite the connection of said leg to the load-receiving part, first and second rotation axes of all legs being parallel and horizontal when the supporting structure (100) is in the use condition on horizontal ground, wherein the supporting structure (100) is adapted to be configured into a reference crossed leg position in the use condition on horizontal ground with the wheels (2*w*) all located on the ground, in which both legs (2) on each lateral side of the load-receiving part (1) extend downwards while crossing each other in projection into a sagittal plane of the supporting structure, wherein the supporting structure (100) is further adapted for performing a lowering of the load-receiving part (1) towards the ground from the reference crossed leg position, by bending each leg (2) upwardly about the second axis (A2) of said leg so as to reduce an angle ($\alpha$) between the upper (2*u*) and lower (21) segments of said leg at the second axis, simultaneously for all four legs, thus increasing a first distance (d1) between both wheels (2*w*) on each lateral side of the load-receiving part, while both legs on each lateral side keep crossing each other in projection into the sagittal plane, said supporting structure (100) configured for forming an exoskeleton for the person in which the load-receiving part (1) is a seat or backrest adapted for supporting at least one among a pelvis or a trunk of the person; and moving the supporting structure on the ground by way of feet of the person contacting and pulling the ground while the pelvis or trunk of the person is supported by the load-receiving part (1), the wheels (2*w*) being freewheels during said moving so as to not impede a motion of the supporting structure (100) on the ground as driven by the person.

* * * * *